US008245333B2

(12) United States Patent
Hamilton et al.

(10) Patent No.: US 8,245,333 B2
(45) Date of Patent: Aug. 21, 2012

(54) ADJUSTABLE DROP LENGTH CRIB SKIRT OR BED SKIRT

(75) Inventors: Marilyn Jean Hamilton, Oakton, VA (US); Heather Lillian Vogl, Oakton, VA (US)

(73) Assignee: Felicitous Concepts Ltd., Oakton, VA (US)

( * ) Notice: Subject to any disclaimer, the term of this patent is extended or adjusted under 35 U.S.C. 154(b) by 0 days.

(21) Appl. No.: 13/210,913

(22) Filed: Aug. 16, 2011

(65) Prior Publication Data

US 2012/0042450 A1 Feb. 23, 2012

Related U.S. Application Data

(60) Provisional application No. 61/374,517, filed on Aug. 17, 2010.

(51) Int. Cl.
*A47G 9/04* (2006.01)

(52) U.S. Cl. ..... 5/493; 5/482; 5/923

(58) Field of Classification Search ..... 5/493, 482, 5/486, 496, 498, 499, 922, 923
See application file for complete search history.

(56) References Cited

U.S. PATENT DOCUMENTS

| | | | | |
|---|---|---|---|---|
| 5,335,383 | A | 8/1994 | Schwind | |
| 5,353,456 | A | 10/1994 | Evans | |
| 5,621,931 | A | 4/1997 | Hamilton | |
| 5,715,553 | A | 2/1998 | Baron et al. | |
| 5,749,110 | A * | 5/1998 | Gamble et al. | 5/493 |
| 5,946,750 | A * | 9/1999 | Shiu | 5/502 |
| 6,151,731 | A | 11/2000 | Saparow | |
| 6,598,249 | B2 | 7/2003 | Pajanacci et al. | |
| 6,792,632 | B2 | 9/2004 | Cohen | |
| 6,925,667 | B2 | 8/2005 | Cohen | |
| 6,971,129 | B2 | 12/2005 | Wootten, Jr. et al. | |
| 7,337,480 | B2 | 3/2008 | Borino | |
| 2007/0022533 | A1 * | 2/2007 | Borino | 5/493 |
| 2007/0022534 | A1 | 2/2007 | Richards | |
| 2008/0222806 | A1 * | 9/2008 | Hart | 5/493 |
| 2012/0042450 | A1 * | 2/2012 | Hamilton et al. | 5/493 |

* cited by examiner

*Primary Examiner* — Robert G Santos
(74) *Attorney, Agent, or Firm* — Guice Patents PLLC

(57) ABSTRACT

A bed skirt includes a platform panel, two first skirt panels, and two second skirt panels. The two first skirt panels include a back first skirt panel and a front first skirt panel, each has a fastening strip attached to a top edge of a corresponding back side. The two second skirt panels include a left second skirt panel and a right second skirt panel, each has a fastening strip attached to a top edge of a corresponding front side. The fastening strip is a hook material. The platform panel is a material to which the fastening strip will firmly adhere. A decorative panel may be connected to each of the skirt panels. The two first skirt panels, the two second skirt panels, and/or the decorative panel may include decoratively shaped edges, gathered portions, pleats, layered fabrics, reversible surfaces, ribbons, embroidery, appliqué, buttons, and/or other decorative embellishments.

16 Claims, 9 Drawing Sheets

ADJUSTABLE DROP LENGTH CRIB SKIRT OR BED SKIRT

This application claims the benefit of U.S. Provisional Application No. 61/374,517, filed Aug. 17, 2010.

FIELD OF THE INVENTION

The present invention relates to a bed skirt for a bed or crib for adjusting a drop length of the bed skirt to accommodate a broad range of bed heights.

BACKGROUND OF THE INVENTION

Known adjustable bed skirts allow a length of the bed skirt to be adjusted. However, adjustment of these conventional bed skirts is limited to either adjusting the bed skirt between preset sizes, or fixing the bed skirt at a single predetermined position. These known adjustable bed skirts do not allow a user to customize the drop length of the bed skirt to properly fit a unique height of numerous mattress and frame combinations.

Conventional bed skirts and crib skirts are usually manufactured with a fixed drop length. However, the distance from the top of a box spring or bed platform to the floor is not a standardized distance, so the bottom of a typical bed skirt may hang a few inches above the floor or "puddle" on the floor if it is too long. For cribs, this problem is compounded by the fact that many cribs are constructed to allow consumers to adjust the crib platform to different heights to accommodate growing infants. For example, a parent may set the platform of the crib at an initial position above the ground for newborns, then lower the platform several inches when the infant is a few months old, and then lower the platform several inches again as the child learns to stand up. Thus, a typical crib skirt with an industry standard drop length will float several inches above the floor whenever the platform is located above the lowest setting, nullifying the aesthetic and dust-preventing utility of a crib skirt.

Other conventional adjustable drop length bed skirts suffer from a number of disadvantages. Some designs require that the skirt be affixed to a box spring mattress using pins or non-slip material. These designs do not work for cribs or beds that do not employ a box spring. Moreover, pins present a safety hazard, especially to children; and skirts held in place by non-slip material located between the box spring and mattress may easily move out of place with normal use of the bed. Other designs use multiple rows of various types of fasteners to permit the sides of a bed skirt to be attached to a platform piece at discrete drop lengths. These designs provide consumers with only a few drop length options, and tend to be expensive to manufacture and/or difficult for the consumer to utilize. Still other crib skirt patterns exist that consist of four side panels with fabric ties, which are tied on to a crib platform made out of a wire mesh. However, it is difficult to affix the ties at a desired height, the ties may come loose, and many cribs are now constructed with flat boards instead of wire mesh platforms, so there is no place to affix the ties.

SUMMARY OF THE INVENTION

The object of the present invention is to provide a bed skirt with a drop length that is adjustable to any length within a broad range.

Another object of the present invention is to provide an adjustable bed skirt that may be repeatedly adjusted to fit the skirt to the particular height of a bed.

Another object of the present invention is to provide an adjustable bed skirt that may be efficiently manufactured and easily assembled by consumers to any desired drop length within a broad range.

Another object of the present invention is to provide an adjustable bed skirt that employs no small parts that might present a safety hazard for infants or children.

DETAILED DESCRIPTION OF THE PREFERRED EMBODIMENT

FIGS. 1-8 illustrate a bed skirt with an adjustable drop length. The bed skirt will be disclosed in conjunction with its use with a bed or crib, but it is to be understood that it will work equally well with any type of bed frame or platform.

Bed skirts (also known as dust ruffles) are commonly placed over a lower portion of a bed or crib to prevent the collection of dust under the bed, cover an unsightly box spring, conceal items that may be stored under the bed, and provide overall aesthetic value. A height that a top of a bed platform or a top of a box spring is located above a floor varies depending on mattress type, mattress manufacturer, frame type, furniture manufacturer, and type of flooring, so the desirable drop length (a length of fabric extending down toward a floor surface) of a bed skirt is also variable. The present bed skirt is particularly useful for use with cribs, but may also be made to fit any size rectangular bed.

Figure 1:
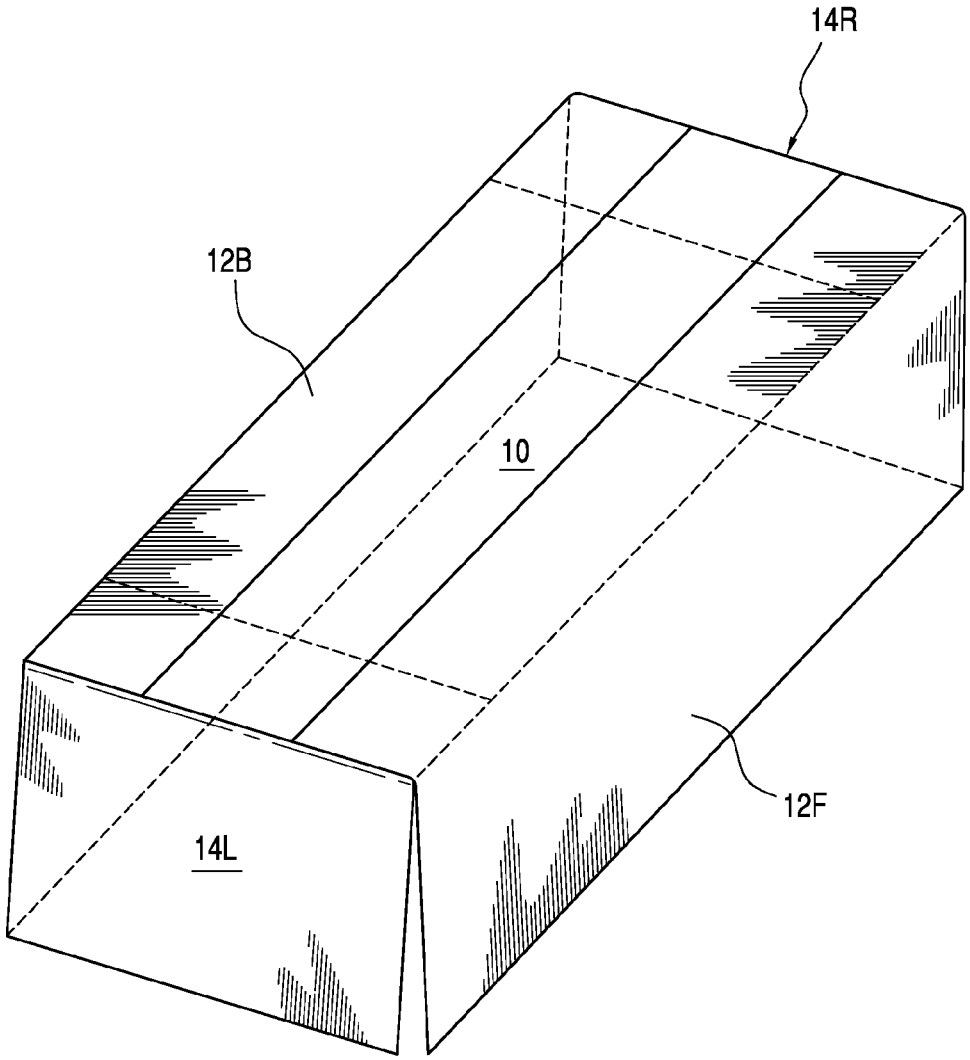
FIG. 1 is a perspective view of the present invention located on a top of a crib platform.
Figure 2:
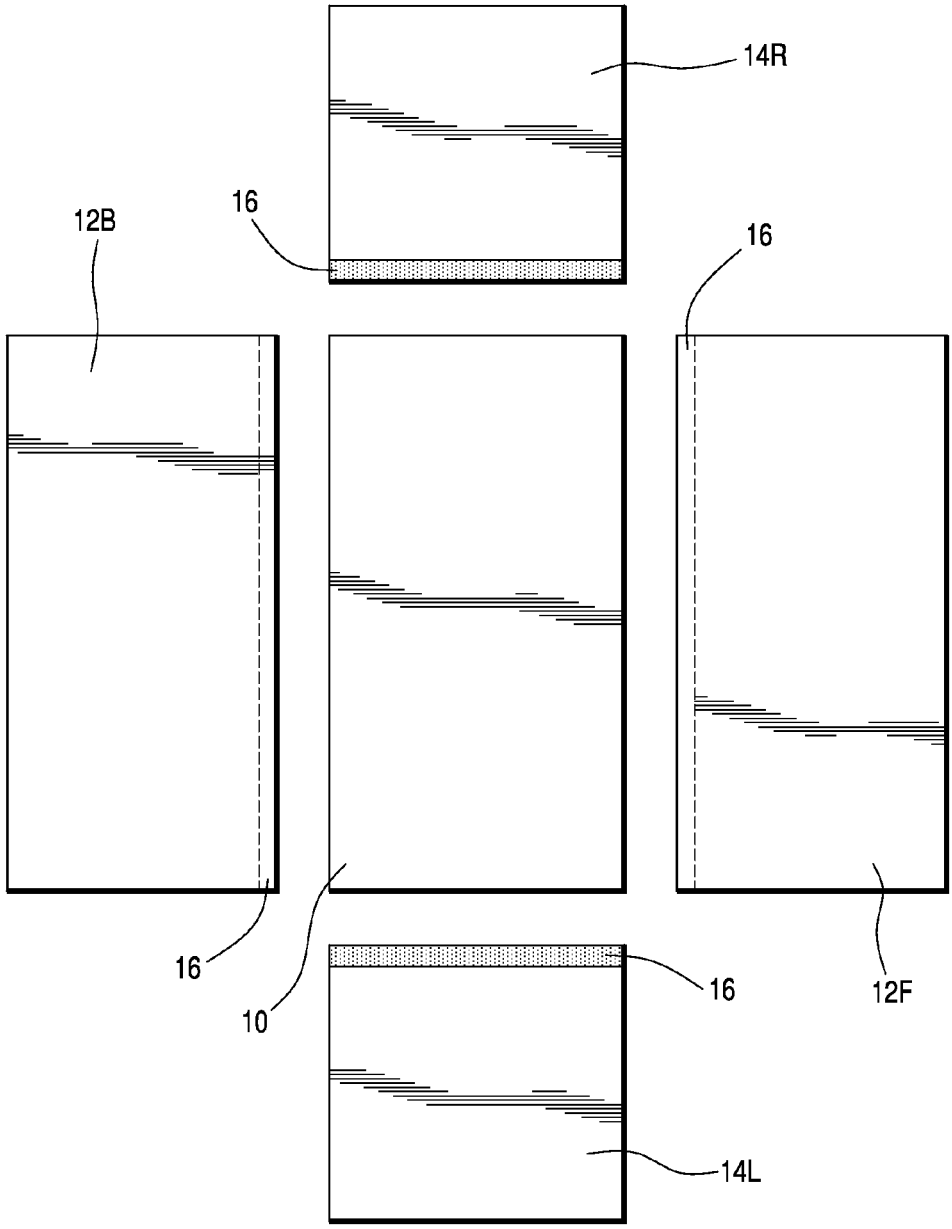
FIG. 2 is an exploded plan view of the present invention.

FIG. 1 illustrates the bed skirt as it would appear lying on top of a crib platform. For illustration purposes, the railing of the crib has been omitted from the figures. As shown in FIG. 2, the bed skirt includes a platform panel 10, two first skirt panels 12, and two second skirt panels 14. The two first skirt panels 12 include a back first skirt panel 12B and a front first skirt panel 12F. The two second skirt panels 14 include a left second skirt panel 14L and a right second skirt panel 14R.

The platform panel 10 has a size corresponding to a top of a box spring or crib platform over which it will be placed, and is made out of a platform material such as synthetic felt or thin stabilized batting to which hook material such as Velcro™ will firmly hold. The platform material functions as the loop portion of a hook and loop fastener.

Each of the two first skirt panels 12, and the two second skirt panels 14 are made of at least one layer of fabric. Each of the back first skirt panel 12B and the front first skirt panel 12F have a fastening strip 16 attached to a top edge of a back side of the fabric. The back first skirt panel 12B and the front first skirt panel 12F may be affixed by a consumer to a top surface of the platform panel 10 at any location using a corresponding fastening strip 16, so long as the back first skirt panel 12B and the front first skirt panel 12F do not overlap each other. Each of the left second skirt panel 14L and the right second skirt panel 14R have a fastening strip 16 attached to a top edge of a front side of the fabric. The left second skirt panel 14L and the right second skirt panel 14R may be affixed by the consumer to a bottom surface of the platform panel 10 at any location using a corresponding fastening strip 16. The fastening strip 16 is a hook portion of a hook and loop fastener such as Velcro™.

Figure 3A:
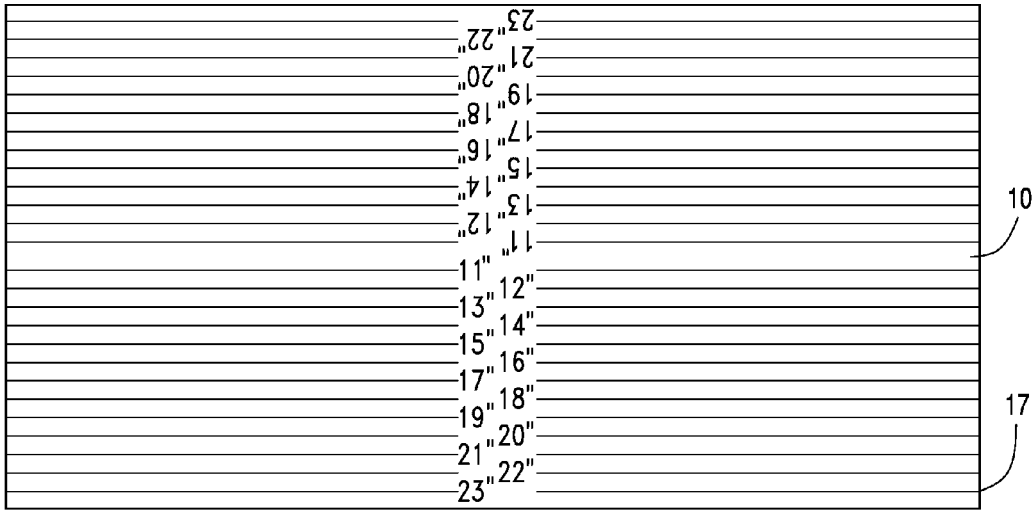
FIG. 3A is a top view of a platform panel of the present invention.
Figure 3B:
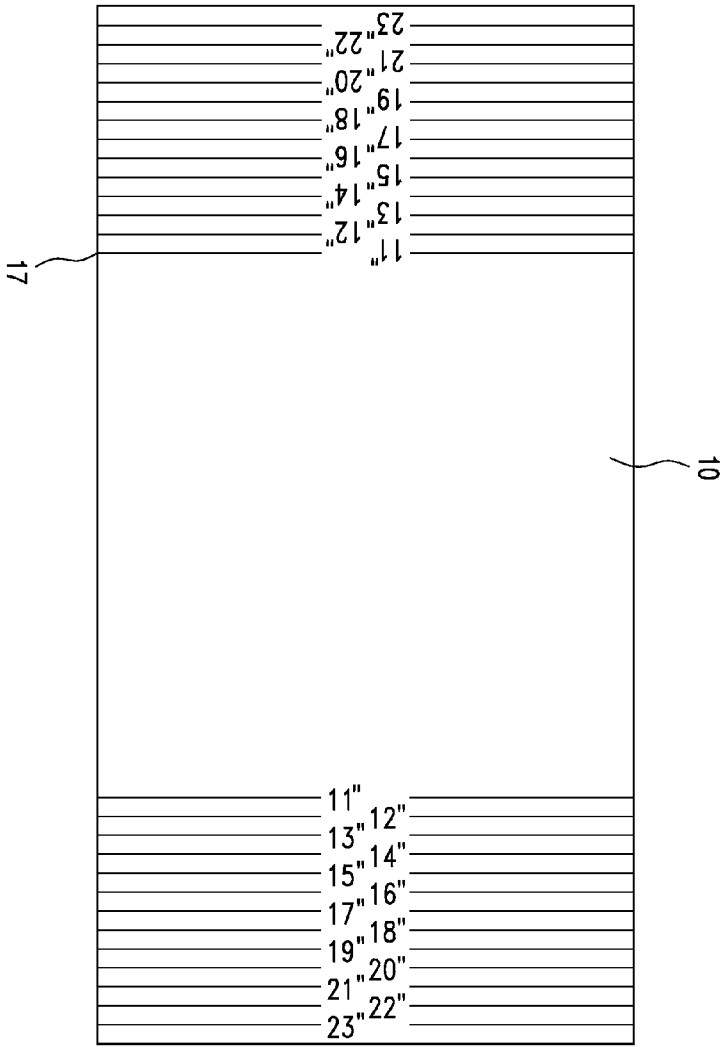
FIG. 3B is a bottom view of a platform panel of the present invention.

FIG. 3A illustrates guideline markings 17 that may be printed and/or stitched onto the top surface of the platform panel 10. FIG. 3B illustrates the guideline markings 17 that may be printed and/or stitched onto the bottom surface of the platform panel 10. The guideline markings facilitate an easy assembly of the bed skirt by the consumer. These guideline markings may be placed to correspond to a height of a bed or crib platform, or box spring, so that the consumer may measure the distance from the bed or crib platform or the top of the box spring to the floor, and then affix the corresponding fastening strip of each of the two first skirt panels 12 and each of two second skirt panels 14 along a correspondingly numbered guideline to produce an assembled skirt unit with a required drop length.

Figure 5A:
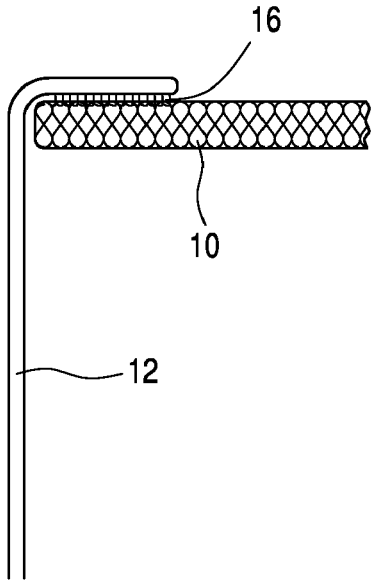
FIG. 5A is a section view of a side of the present invention.
Figure 5B:
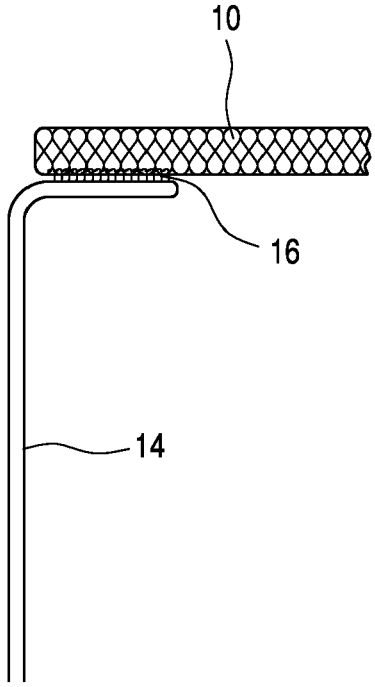
FIG. 5B is a section view of an end of the present invention.

In the simplest construction of this adjustable drop length bed skirt, the two first skirt panels 12 and the two second skirt panels 14 are would be flat pieces of fabric, with the fastening strip 16 (a hook fastener) attached directly to an edge of the corresponding panel, as illustrated in FIG. 5A and FIG. 5B.

Figure 4:
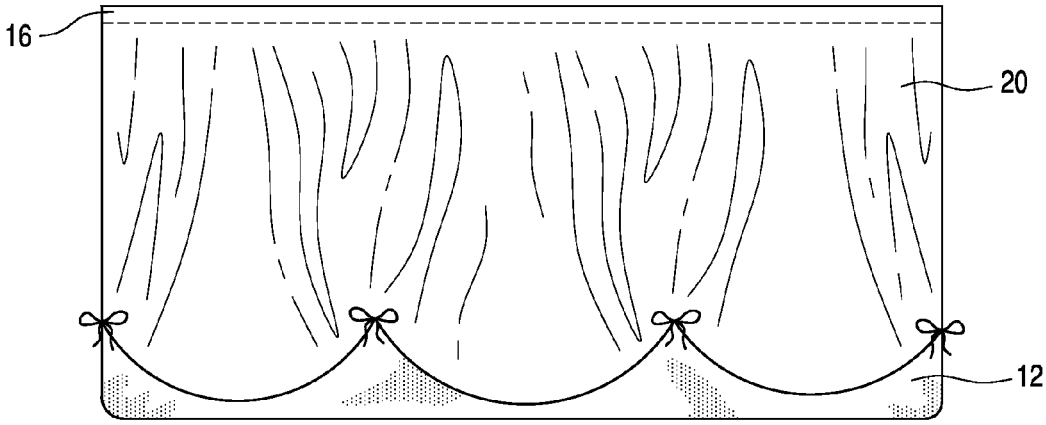
FIG. 4 is a side view of the present invention with a decorative panel.
Figure 6A:
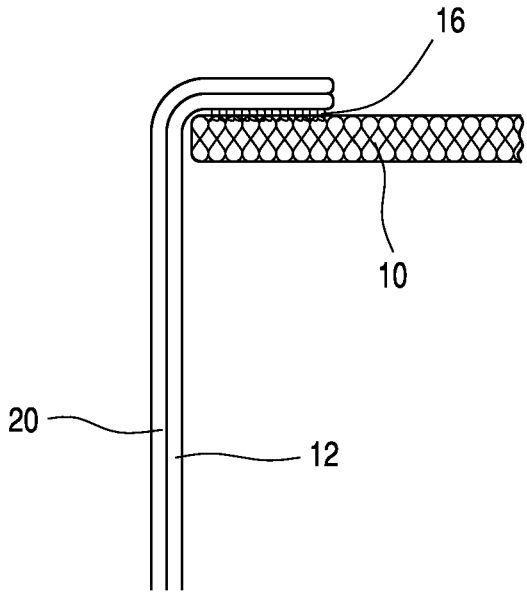
FIG. 6A is a section view of a side of the present invention with a decorative panel.
Figure 6B:
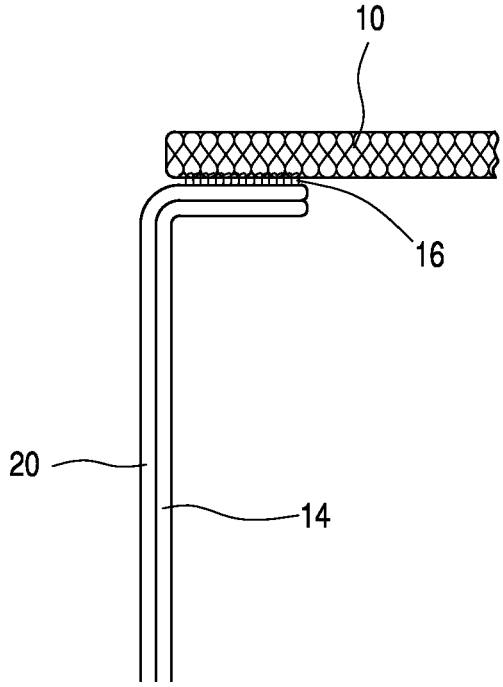
FIG. 6B is a section view of an end of the present invention with a decorative panel.

Each of the two first skirt panels 12 and the two second skirt panels 14 can have a more decorative construction, including scalloped or otherwise decoratively shaped edges, gathered, pleated, layered, and reversible styles. FIG. 4 illustrates one such decorative side panel design where one of the two first skirt panels 12 is overlaid with a decorative panel 20 that has scalloped edges and decorative ribbons. The decorative panel 20 is made of at least one layer of fabric and can have a more decorative construction, including scalloped or otherwise decoratively shaped edges, gathered, pleated, layered, and reversible styles. As illustrated in FIG. 6A and FIG. 6B, for reversible or layered applications, the decorative panel 20 may be sewn onto each of the first skirt panels 12 and the second skirt panels 14 before attaching the fastening strip 16. In all cases, the fastening strip 16 must be attached to the back side (an inverse side or a secondary side) of the fabric for each of the back first skirt panel 12B and the front first skirt panel 12F, and on the front side (a "right" side or a primary side) of the fabric for each of the left second skirt panel 14L and the right second skirt panel 14R, or vice versa.

Figure 7:
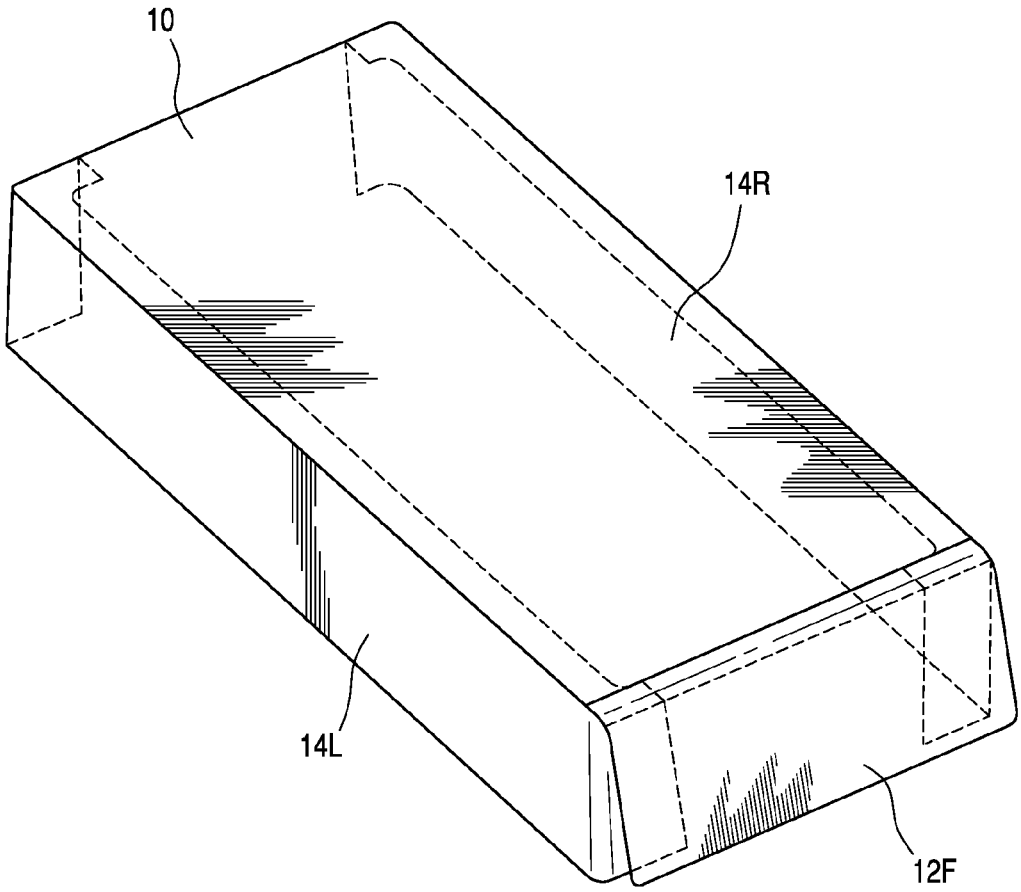
FIG. 7 is a perspective view of the present invention with skirt panels overlapping.
Figure 8:
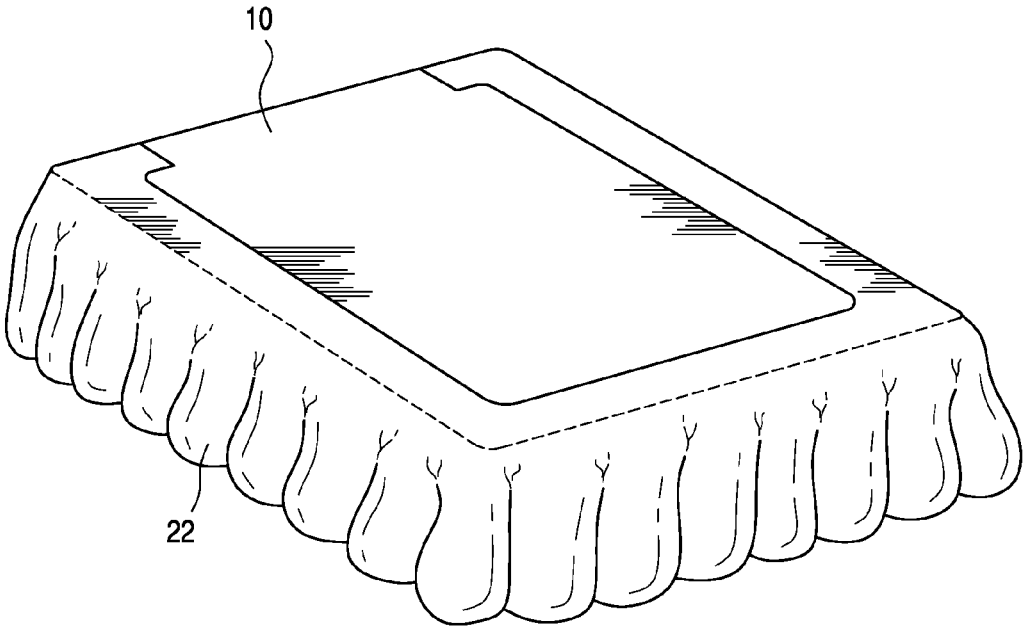
FIG. 8 is a perspective view of the present invention with a single skirt panel.

Other modifications of the bed skirt are possible. For example:

1. The guideline markings may be omitted from the platform piece for simpler manufacturing, and consumers may be instructed how to measure and affix the first skirt panels 12 and second skirt panels 14 properly.
2. The two first skirt panels 12 and the two second skirt panels 14 may be made from different fabrics, and they may be embellished with numerous types of decorative attachments, including but not limited to ribbons, embroidery, appliqués, buttons, and any decorative embellishment. However, some types of decorative attachments might present a safety hazard for infants and children if pulled off, in which case they would not be advisable for crib skirt applications.
3. One or more of the two first skirt panels 12 and the two second skirt panels 14 may be omitted, such as those panels that would not be visible. For example, the back side of a crib will usually be placed against a wall, so the skirt panel located on the back of the crib may be omitted. Similarly, for adult beds, usually the head of the bed will be placed against a wall and/or have a headboard attached, so the skirt panel located at the head of the bed may be omitted.
4. The bed skirt may be constructed in numerous sizes, including but not limited to cribs, twin beds, double beds, queen size or king size beds, or any other rectangular mattress size.
5. Each of the two first skirt panels 12 may have a width that is wider than a width of each of the two second skirt panels 14, or vice versa. For instance, in the preferred embodiment of the bed skirt for an adult-sized bed, the front first skirt panel 12F would be sized to be affixed to a foot of the bed (and the back first skirt panel 12B would be the same size if it is not omitted), and the left second skirt panel 14L and the right second skirt panel 14R would be sized to be affixed to the long sides of the bed.
6. In an adult-sized bed skirt application, the left second skirt panel 14L and the right second skirt panel 14R may be constructed slightly wider than the length of platform piece 10 to allow the ends of these skirt panels to wrap around each corner. Sides of the front first skirt panel 12F (and optionally the back first skirt panel 12B) would then overlay side edges of the left second skirt panel 14L and the right second skirt panel 14R when the bed skirt unit is positioned over the bed platform or the top of the box spring. Overlapping the side edges of the first skirt panels 12 and second skirt panels 14 would prevent a visible gap at the foot corners and neatly cover the head corners, as illustrated in FIG. 7.
7. The platform piece 10 may be sized slightly smaller than the dimensions of the overlaid mattress to prevent the edges of the platform piece 10 from being visible when the bed skirt unit is assembled and the mattress is placed on top.
8. As illustrated in FIG. 8, in the adult-sized bed skirt application, the first skirt panels 12 and the second skirt panels 14 may be made as a single skirt panel 22 that attaches around the perimeter of platform piece 10. When the single skirt panel 22 is made to cover three sides of the bed, a minimum width of the single skirt panel 22 must be sufficient to wrap around the two sides and the foot of the bed. The single skirt panel 22 has a fastening strip 16 attached to a top edge of a back side of the fabric, extending an entire width of the skirt. In order for the drop-length to be adjustable and still hang properly at the corners, the single skirt panel 22 is made with gathers or very small pleats. The fastening strip 16 may be affixed by the consumer to the edge of the platform piece 10 for the longest application, or attached to the platform piece 10 a uniform distance away from the edge, not to exceed a few inches (the precise limit would depend largely on the "tightness" of the gathers or pleats) for shorter applications.

Since the entire platform panel 10 functions as the loop side, consumers can adjust where each of the first skirt panels 12 and second skirt panels 14 is attached in order to produce any desired drop length within a range. The assembled bed skirt unit can then be placed on the crib or bed platform or box spring, and a mattress may then be placed on top of the bed skirt unit. The assembly process will take the consumer just a few minutes. An advantage of the bed skirt is that the drop length can be changed easily at any time, and the hook-and-loop connection is strong enough to prevent the side panels from coming loose and out of alignment. The two first skirt panels 12 and the two second skirt panels 14 are affixed to opposite surfaces of the platform panel, so the two first skirt panels 12 do not interfere with the connection of the two second skirt panels 14, allowing all of the panels to have a secure hook-and-loop connection.

While the present invention has been illustrated and described in detail with respect to the preferred embodiments thereof, numerous modifications and variations could be made thereto by those skilled in the art without departing from the scope and spirit of the invention set forth in the claims.

The invention claimed is:

1. A bed skirt assembly for covering a top bed surface of a box spring or a platform of a bed, the bed skirt assembly comprising:

a platform panel positioned on the top bed surface; and at least one skirt panel having at least one layer of fabric and a fastening strip connected along a width of a top edge thereof; the fastening strip directly connecting the at least one skirt panel to a surface of the platform panel, the at least one skirt panel includes two first skirt panels and two second skirt panels, the two first skirt panels include a back first skirt panel and a front first skirt panel, the two second skirt panels include a left second skirt panel and a right second skirt panel, each of the back first skirt panel and the front first skirt panel has a corresponding fastening strip attached to a top edge of a back side thereof and each of the left second skirt panel and the right second skirt panel has a corresponding fastening strip attached to a top edge of a front side thereof;

wherein a drop length of the at least one skirt panel is adjustable between a longer length and a shorter length by decreasing and increasing a distance that the fastening strip is located relative to a periphery of the platform panel;

wherein the back first skirt panel and the front first skirt panel are adjustably and directly connected to a top surface of the platform panel via a corresponding fastening strip and the left second skirt panel and the right second skirt panel are adjustably and directly connected to a bottom surface of the platform panel via a corresponding fastening strip.

2. The bed skirt assembly according to claim 1, wherein the at least one skirt panel has at least one of a group consisting of decoratively shaped edges, gathered portions, pleats, layered fabrics, reversible surfaces, ribbons, embroidery, appliqué, buttons, and decorative embellishments.

3. The bed skirt assembly according to claim 1, further comprising at least one decorative panel having at least one layer of fabric connected to the at least one skirt panel.

4. The bed skirt assembly according to claim 3, wherein the at least one decorative panel has at least one of a group consisting of decoratively shaped edges, gathered portions, pleats, layered fabrics, reversible surfaces, ribbons, embroidery, appliqué, buttons, and decorative embellishments.

5. The bed skirt assembly according to claim 1, wherein each of the back first skirt panel and the front first skirt panel has a width equal to a corresponding side of a periphery of the top bed surface.

6. The bed skirt assembly according to claim 1, wherein each of the left second skirt panel and the right second skirt panel has a width greater than a corresponding side of a periphery of the top bed surface.

7. The bed skirt assembly according to claim 1, wherein the platform panel has a size corresponding to a size of the top bed surface.

8. The bed skirt assembly according to claim 1, wherein the platform panel has a size that is smaller than a size of the top bed surface.

9. The bed skirt assembly according to claim 1, wherein the platform panel has guideline markings located on at least one surface thereof.

10. The bed skirt assembly according to claim 1, wherein the platform panel is a material functioning as a loop portion of a hook and loop fastener.

11. The bed skirt assembly according to claim 1, wherein each fastening strip is a material functioning as a hook portion of the hook and loop fastener.

12. The bed skirt assembly according to claim 1, wherein each of the back first skirt panel and the front first skirt panel has a width greater than a corresponding side of a periphery of the top bed surface.

13. The bed skirt assembly according to claim 1, wherein each of the left second skirt panel and the right second skirt panel has a width equal to a corresponding side of a periphery of the top bed surface.

14. The bed skirt assembly according to claim 1, wherein each of the left second skirt panel and the right second skirt panel has a width that is greater than a width of each of the back first skirt panel and the front first skirt panel.

15. The bed skirt assembly according to claim 1, wherein each of the back first skirt panel and the front first skirt panel has a width that is greater than a width of each of the left second skirt panel and the right second skirt panel.

16. The bed skirt assembly according to claim 1, wherein the back first skirt panel and the front first skirt panel are adjustable along the top surface of the platform panel and the left second skirt panel and the right second skirt panel are adjustable along the bottom surface of the platform panel.

* * * * *